US009009895B2

(12) United States Patent
Turner et al.

(10) Patent No.: US 9,009,895 B2
(45) Date of Patent: Apr. 21, 2015

(54) ARTICULABLE BED WITH A TRANSLATABLE AND ORIENTATION ADJUSTABLE DECK SECTION AND VOLUMETRICALLY ADJUSTABLE COMPENSATORY ELEMENT

(75) Inventors: Jonathan D. Turner, Dillsboro, IN (US); David W. Hornbach, Brookville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 380 days.

(21) Appl. No.: 13/412,129

(22) Filed: Mar. 5, 2012

(65) Prior Publication Data

US 2013/0227788 A1 Sep. 5, 2013

(51) Int. Cl.

| | |
|---|---|
| ***A61G 7/015*** | (2006.01) |
| ***A61G 7/018*** | (2006.01) |
| ***A61G 7/07*** | (2006.01) |
| *A61G 7/057* | (2006.01) |

(52) U.S. Cl.

CPC ..... *A61G 7/015* (2013.01); *A61G 7/018* (2013.01); *A61G 7/05769* (2013.01); *A61G 7/07* (2013.01); *A61G 2203/34* (2013.01); *A61G 2203/42* (2013.01); *A61G 2203/44* (2013.01)

(58) Field of Classification Search

CPC ... A61G 7/015; A61G 7/018; A61G 2203/42; A61G 2007/0527; A61G 7/05769; A61G 7/07; A61G 13/08; A61G 13/122; A61G 13/1225; A61G 13/1265

USPC ..... 5/613–618, 633, 634

See application file for complete search history.

(56) References Cited

U.S. PATENT DOCUMENTS

| | | | | |
|---|---|---|---|---|
| 5,715,548 | A * | 2/1998 | Weismiller et al. | 5/624 |
| 5,873,137 | A * | 2/1999 | Yavets-Chen | 5/713 |
| 6,141,806 | A | 11/2000 | Bobey et al. | |
| 6,499,166 | B1 * | 12/2002 | Jones | 5/689 |
| 7,296,312 | B2 * | 11/2007 | Menkedick et al. | 5/611 |
| 7,418,751 | B1 * | 9/2008 | Bartlett et al. | 5/609 |
| 8,266,742 | B2 * | 9/2012 | Andrienko | 5/600 |
| 8,413,273 | B2 * | 4/2013 | Hornbach et al. | 5/611 |
| 2009/0064416 | A1 | 3/2009 | Kummer et al. | |
| 2010/0122415 | A1 | 5/2010 | Turner et al. | |
| 2012/0054964 | A1 * | 3/2012 | Stroh et al. | 5/613 |

FOREIGN PATENT DOCUMENTS

EP 0261830 A2 3/1988

OTHER PUBLICATIONS

European Search Report for Application EP13157672; Place of Search—The Hague; Date of Completion of the Search—Jun. 14, 2013.

* cited by examiner

*Primary Examiner* — Nicholas Polito
(74) *Attorney, Agent, or Firm* — Kenneth C. Baran

(57) ABSTRACT

A bed comprises a deck having at least one section that is orientation adjustable about a laterally extending, longitudinally translatable axis and a mattress assembly including at least one volumetrically adjustable element associated with the orientation adjustable deck section. The volumetrically adjustable element is adapted to change the thickness of a portion of the mattress assembly adjacent to the deck section in a direction nonparallel to the orientation of the section and in response to a change in orientation of the deck section.

83 Claims, 9 Drawing Sheets

ARTICULABLE BED WITH A TRANSLATABLE AND ORIENTATION ADJUSTABLE DECK SECTION AND VOLUMETRICALLY ADJUSTABLE COMPENSATORY ELEMENT

TECHNICAL FIELD

The subject matter described herein relates to beds of the type used in hospitals, other health care facilities and home care settings, in particular an articulable bed with a translatable and orientation adjustable deck section and a volumetrically adjustable element that compensates for anthropometric performance compromises arising from occupant non-specific translations and rotations of the deck.

BACKGROUND

U.S. patent application Ser. No. 12/618,256, filed on Nov. 13, 2009 and entitled "Anthropometrically Governed Occupant Support" describes an articulating bed whose articulation is governed, at least in part, by anthropometric considerations. The described bed includes an upper body section that is longitudinally translatable in a positive or headward direction (toward the head end of the bed) and a negative or footward direction (toward the foot end of the bed). An upper body frame and deck section are pivotable about a laterally extending rotational axis so that the deck section can be placed at an angular orientation $\alpha$ relative to the bed upper frame. Rotation that pivots the upper body frame and deck section away from the bed upper frame is positive rotation whereas rotation that pivots the upper body frame and deck section toward the upper bed frame is negative rotation. The upper body deck is also slidable relative to the upper body deck frame in a direction parallel to the existing orientation of the upper body deck frame. This motion is referred to as "parallel translation" to distinguish it from the longitudinal translation of the upper body section. Positive parallel translation is translation toward the head or upper end of the upper body frame whereas negative parallel translation is translation toward the foot or lower end of the upper body frame. The above mentioned conventions for positive and negative translation, rotation and parallel translation will be adhered to in the present application.

One embodiment of the bed described in the application features a simplified kinematic configuration for translating the upper body section longitudinally and changing its angular orientation. The application also describes "compensatory translation" of the leg section of the bed to mitigate a sacrifice of anthropometric performance arising from the simplified kinematics.

The present application describes a bed that employs an alternate way to achieve the benefit of the compensatory translation.

SUMMARY

A bed described herein comprises a deck having at least one section that is orientation adjustable about a laterally extending, longitudinally translatable axis, and a mattress assembly including at least one volumetrically adjustable element associated with the orientation adjustable deck section. The volumetrically adjustable element is adapted to change the thickness of a portion of the mattress assembly adjacent to the deck section in a direction nonparallel to the orientation of the section and in response to a change in orientation of the deck section.

BRIEF DESCRIPTION OF THE DRAWINGS

The foregoing and other features of the various embodiments of the bed described herein will become more apparent from the following detailed description and the accompanying drawings in which.

DETAILED DESCRIPTION

Figure 1:
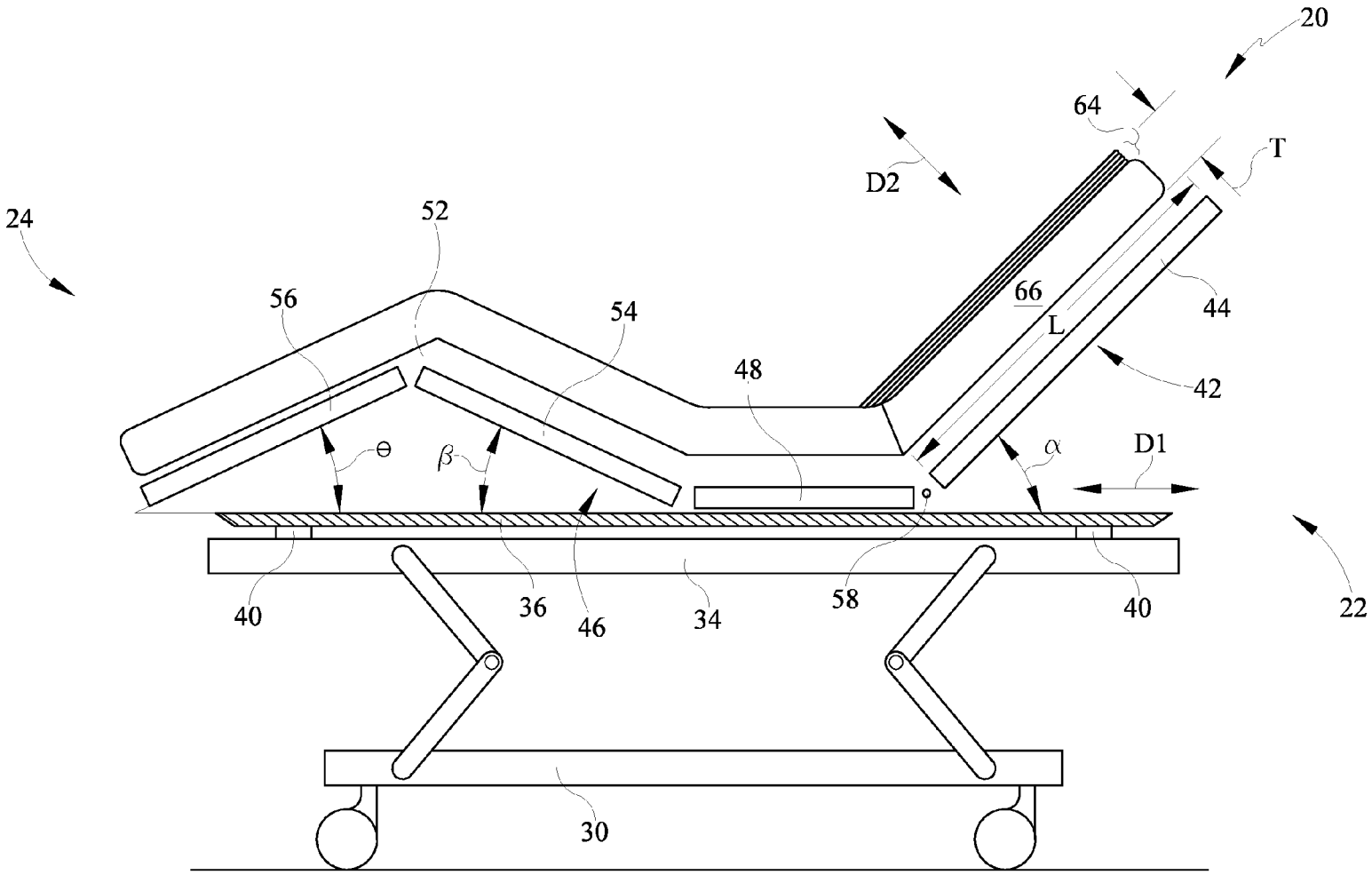
FIG. 1 is a simplified, side elevation view of a hospital bed.
Figure 2:
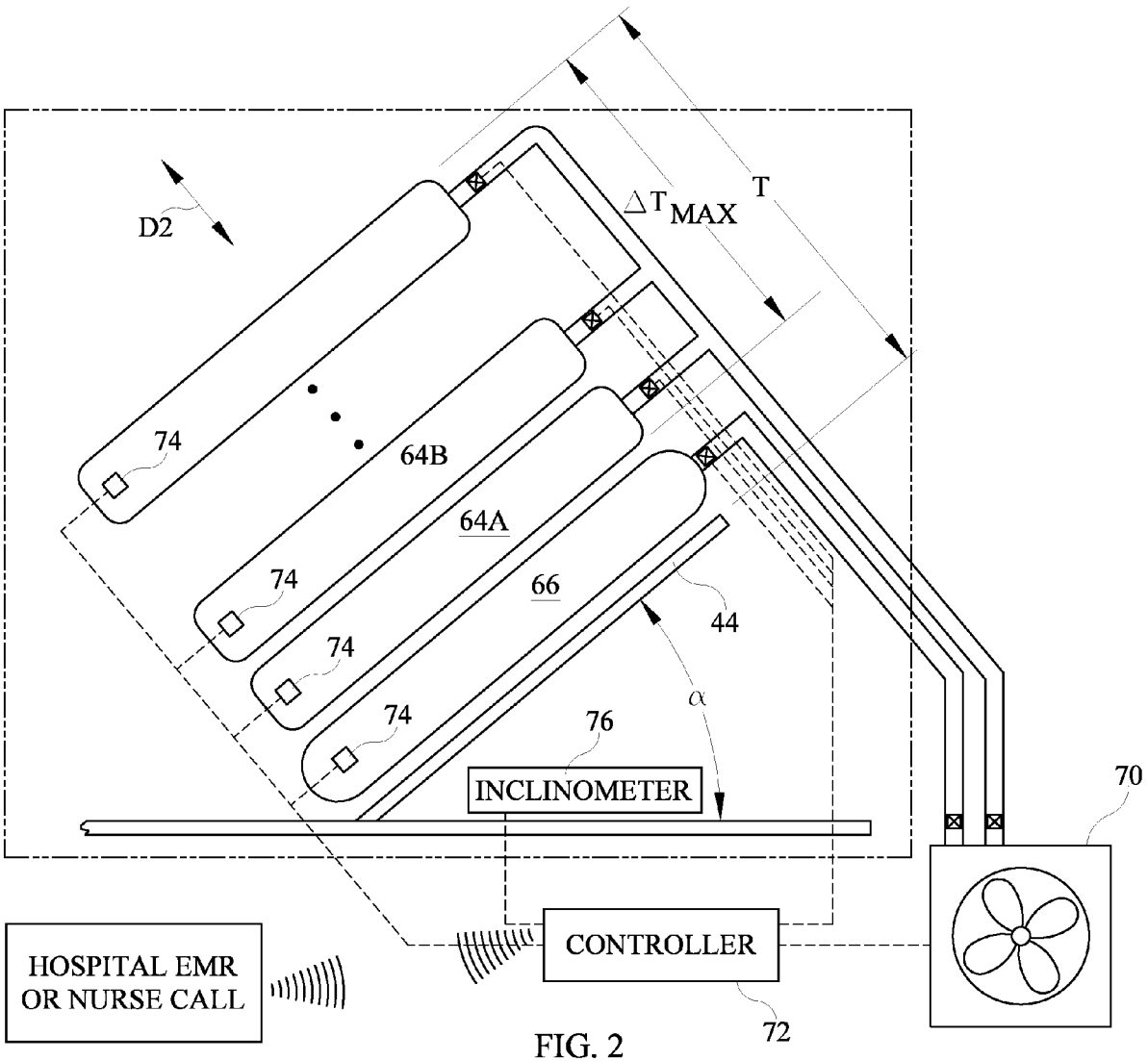
FIG. 2 is a schematic showing a set of compensatory bladders, a blower and a plumbing network for inflating the bladders, and a controller for operating the blower and a system of valves to achieve the desired inflation of the desired quantity of bladders.

Referring to FIGS. 1 and 2, a hospital bed 20 extends longitudinally from a head end 22 to a foot end 24 and laterally from a left side (seen in the plane of the illustrations) to a right side. The bed comprises a base frame 30, and an intermediate frame 34 mounted on the base frame such that the intermediate frame can be raised or lowered in elevation relative to the base frame. The bed also includes a weigh frame 36 mounted on the intermediate frame such that the load path from the weigh frame to the intermediate frame extends through load cells 40. The load cells enable measurement of the weight of an occupant of the bed. The bed also includes a segmented deck 42 comprising an upper body section 44 having a longitudinal length L and corresponding approximately to an occupant's torso, and a lower body section 46. The lower body section includes a seat section 48 corresponding approximately to the occupant's buttocks and a leg section 52, which further comprises a thigh section 54 corresponding approximately to the occupant's thighs and a calf section 56 corresponding approximately to the occupant's calves and feet. The angular orientation $\alpha$ of the upper body section is adjustable about a laterally extending axis 58. The upper body section, including its axis 58 are longitudinally translatable as indicated by directional arrow D1. The angular orientations $\beta$, $\theta$, of the thigh and calf sections are also adjustable.

The bed also includes a mattress assembly including at least one volumetrically adjustable element associated with orientation adjustable upper body deck section 44. The volumetrically adjustable element is adapted to change the thickness T of a portion of the mattress assembly adjacent to deck section in a direction D2 nonparallel to the orientation of the deck section 44 and in response to a change in orientation $\alpha$ of the deck section. Direction D2 is approximately perpendicular to the orientation of the deck section. In the illustrated embodiment the volumetrically adjustable element comprises multiple inflatable bladders 64, referred to herein as compensatory bladders, each capable of effecting only part of a maximum attainable change $\Delta T_{max}$ in the thickness T of the mattress assembly. The illustrated embodiment also includes a substantially constant thickness base 66 between the volumetrically adjustable element and the orientation adjustable deck section. The illustrated base is a bladder which is inflated to a working pressure and is then maintained at substantially that same pressure during routine use of the bed. Alternatively the base may be a noninflatable base, for example a base made of a foam material.

The bed also includes a blower 70 for supplying air to pressurize the inflatable bladders 64 and a controller 72 for regulating the change of thickness in response to a change in orientation of the deck section. Pressure sensors 74 may be provided to sense bladder pressure in order to assess whether a bladder of interest is fully inflated, partially inflated or substantially deflated. The bed also includes an inclinometer 76 for determining orientation angle $\alpha$. When $\alpha$ is 0, all the bladders are substantially deflated. The controller can communicate with remote system either by a wired connection or by a wireless connection, as shown. Examples of remote systems include hospital communication networks, nurse call systems, nurse call stations and digital or electronic medical records.

A user interface (not illustrated) is provided so that a user can inform the controller of the physical characteristics of the specific occupant who is occupying or about to occupy the bed.

Figure 3:
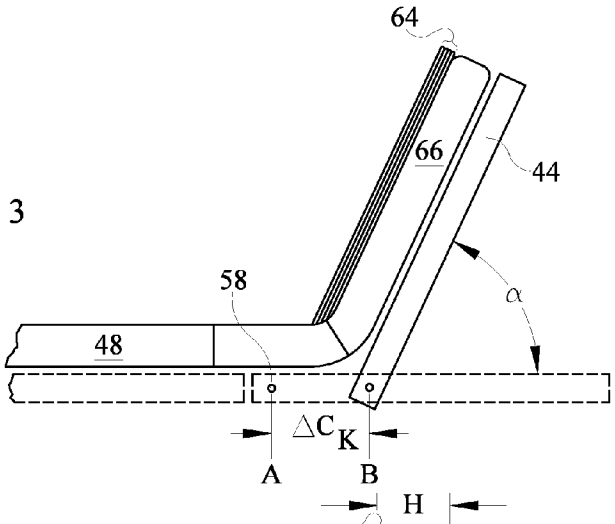
FIG. 3 is a simplified side elevation view of a portion of the bed of FIG. 1 showing a deck upper body section translatable through a distance $\Delta C_K$ to accommodate a maximum occupant and having a set of compensatory bladders and showing the bladders in a deflated state to accommodate the maximum occupant.

Referring to FIG. 3 the bed is shown with the upper body section at a flat orientation ($\alpha$=0°) and with axis 58 at a longitudinal location A (dashed lines) and with the upper body section at its maximum inclination ($\alpha$ approximately 65°) and with axis 58 at longitudinal location B (solid lines). The longitudinal distance between A and B is $\Delta C_K$. $\Delta C_K$ is the longitudinal translation arising from the kinematic relationship between deck upper body section translation and deck angular orientation $\alpha$ when the upper body section is rotated about axis 58 from its minimum orientation of 0° to its maximum orientation of about 65°. The value of $\Delta C_K$ is prescribed by a designer and, in the example of FIG. 3, is chosen to accommodate a "maximum" occupant selected from a population of occupants. In other words the maximum occupant is the "design point" occupant for the kinematics. The maximum occupant is the occupant whose physical characteristics (e.g. height, weight, body mass index) are at the upper end of the population under consideration. The maximum occupant may be thought of as a 100th percentile occupant. Similarly, a "minimum" occupant is an occupant whose physical characteristics are at the lower end of the population under consideration. The minimum occupant may be thought of as a 0th percentile occupant. Other occupants whose physical characteristic or characteristics of interest fall between those of the maximum and minimum occupants can likewise be identified by a percentile rank, e.g. 25th percentile, 50th percentile, 75th percentile. The relative ranking of occupants will be referred to herein by phrases such as "smaller", "less than", "larger" and "more than". For example a 50th percentile person is "smaller" or "less than" a 75th percentile person and is "larger" or "more than" a 25th percentile person.

Continuing to refer to FIG. 3, controller 72, in response to the change in deck section orientation from 0° to 65°, has issued commands to change the thickness of the portion of the mattress assembly adjacent to deck section 44 by a baseline amount for a maximum bed occupant. In the example of FIG. 3 the controller has previously received a user input by way of the user interface specifying that the occupant is a maximum occupant. The command issued by the controller is a null command and the baseline amount is zero so that bladders 64, which were uninflated at $\alpha$=0, remain uninflated, thereby accommodating the maximum bed occupant.

Figure 4:
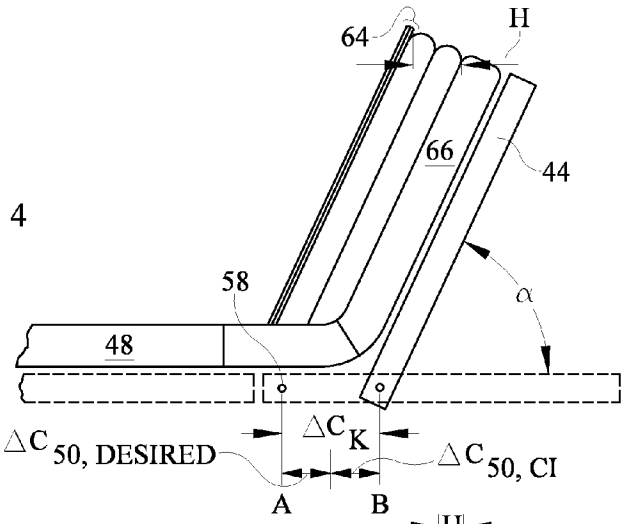
FIGS. 4-6 are views similar to that of FIG. 3 each showing a subset of the compensatory bladders inflated to accommodate a 50th percentile occupant, a 25th percentile occupant and a 75th percentile occupant.

FIG. 4 shows operation of the bed of FIG. 3 for a less than maximum occupant. In the example of FIG. 4 the occupant is a 50th percentile member of the population and the controller 72 has been informed, by way of user input, that a 50th percentile individual is or will be occupying the bed. Because the kinematics of the bed were designed for a maximum occupant, the longitudinal translation of the deck upper body section associated with a change of $\alpha$ from 0° to 65° is $\Delta C_K$, just as in FIG. 3. However this translation is nonoptimal for the 50th percentile occupant because the upper body section translation desired for the 50th percentile occupant is only $\Delta C_{50,DESIRED}$. Hence, the controller has issued commands to change the thickness of the portion of the mattress assembly adjacent to deck section 44 by an amount compatible with the needs of the 50th percentile occupant. The change of thickness compatible with the smaller, 50th percentile occupant is greater than that required to accommodate larger occupants, such as the maximum occupant. In the example of FIG. 4 the command is a command to fully inflate two of the four compensatory bladders 64. The resulting horizontal component H of the increased thickness of the mattress assembly adjacent to upper body section deck section 44 is equal or approximately equal to $\Delta C_{50,CI}$ where the "CI" portion of the subscript stands for "compensatory inflation". The magnitude of H compensates for the overtravel of the deck upper body section thereby better accommodating the 50th percentile bed occupant.

Figure 5:
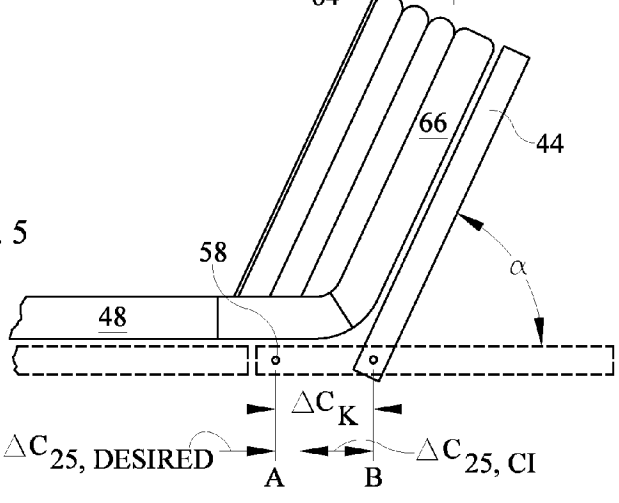

FIG. 5 is similar to FIG. 4 but assumes that the occupant is a 25th percentile member of the population and that the controller 72 has been informed, by way of user input, that a 25th percentile individual is or will be occupying the bed. Because the kinematics of the bed were designed for a maximum occupant, the longitudinal translation of the deck upper body section associated with a change of $\alpha$ from 0 to 65 is $\Delta C_K$, just as in the earlier examples. However this translation is nonoptimal for the 25th percentile occupant because the upper body section translation desired for the 25th percentile occupant is only $\Delta C_{25,DESIRED}$. Hence, the controller has issued commands to change the thickness of the portion of the mattress assembly adjacent to deck section 44 by an amount compatible with the needs of the 25th percentile occupant. In the example of FIG. 5 the command is a command to fully inflate three of the four compensatory bladders 64. The resulting horizontal component H of the increased thickness of the mattress assembly adjacent to upper body section deck section 44 is equal or approximately equal to $\Delta C_{25,CI}$ where the "CI" portion of the subscript stands for "compensatory inflation". The magnitude of H compensates for the overtravel of the deck upper body section thereby better accommodating the 25th percentile bed occupant.

Figure 6:
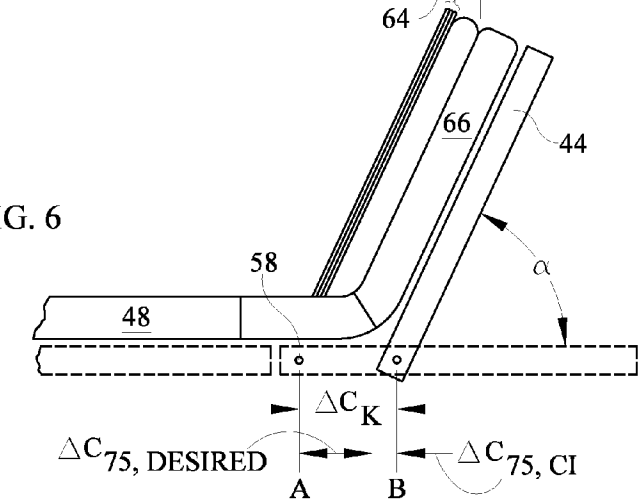

FIG. 6 is similar to the previous figures but assumes that the occupant is a 75th percentile member of the population and that the controller 72 has been informed, by way of user input, that a 75th percentile individual is or will be occupying the bed. Because the kinematics of the bed were designed for a maximum occupant, the longitudinal translation of the deck upper body section associated with a change of $\alpha$ from 0° to 65° is $\Delta C_K$, just as in the earlier examples. However this translation is nonoptimal for the 75th percentile occupant because the upper body section translation desired for the 75th percentile occupant is only $\Delta C_{75,DESIRED}$. Hence, the controller has issued commands to change the thickness of the portion of the mattress assembly adjacent to deck section 44 by an amount compatible with the needs of the 75th percentile occupant. In the example of FIG. 6 the command is a command to fully inflate one of the four compensatory bladders 64. The resulting horizontal component H of the increased thickness of the mattress assembly adjacent to upper body section deck section 44 is equal or approximately equal to $\Delta C_{75,CI}$ where the "CI" portion of the subscript stands for "compensatory inflation". The magnitude of H compensates for the overtravel of the deck upper body section thereby better accommodating the 75th percentile bed occupant.

Figure 7:
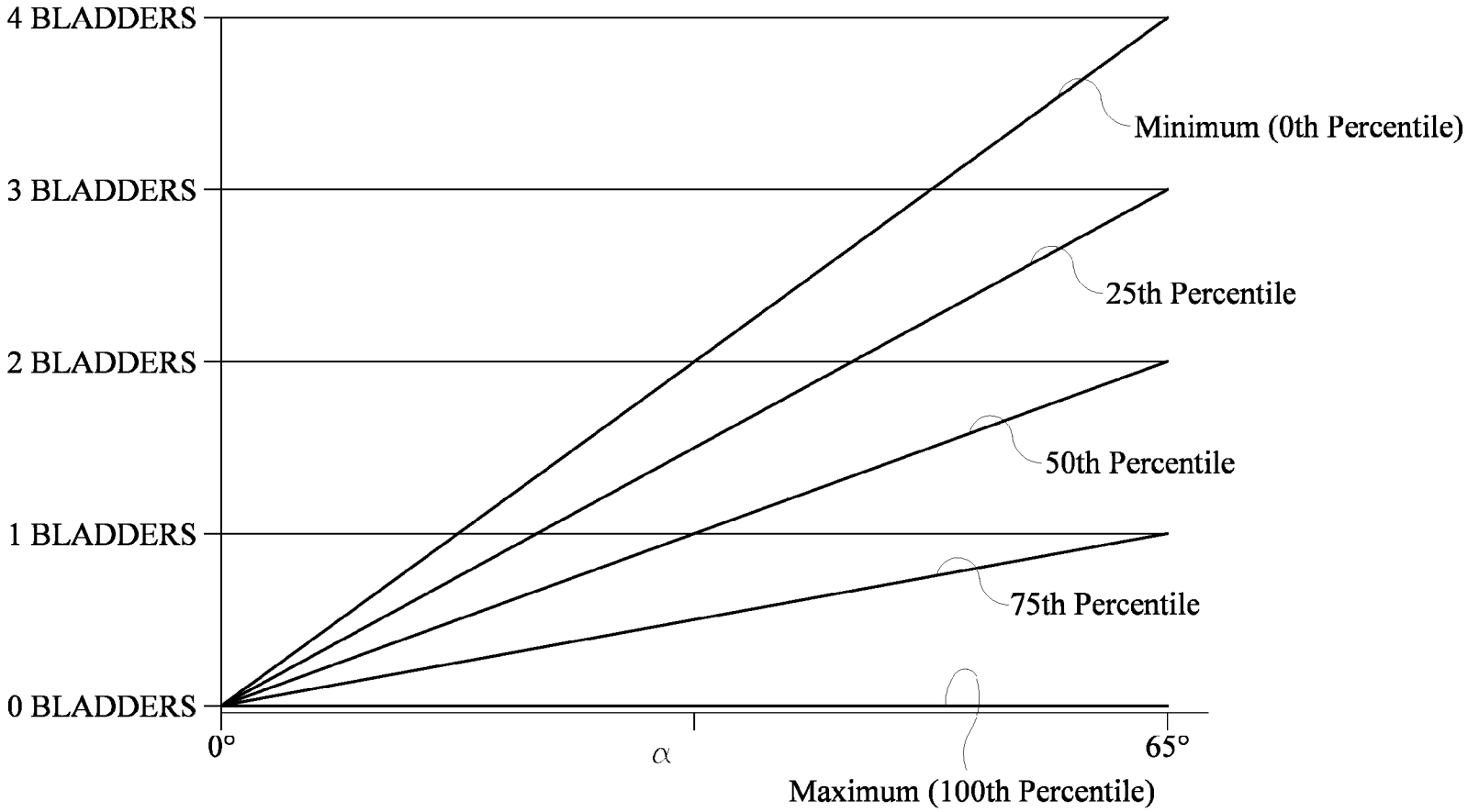
FIG. 7 is a schedule of compensatory bladder inflation as a function of the angular orientation of the upper body section of the bed and occupant size.

Because the examples of FIGS. 4-6 show a nonzero thickness increase, those examples make it possible to illustrate the orientation dependence of the change in mattress thickness. The examples of FIGS. 4-6 assume that the deck upper body section has been reoriented from its minimum orientation angle of 0° to its maximum orientation angle of 65°. If, however, the deck had been reoriented from 0° to an angle of less than 65°, the commanded change of thickness would have been less. FIG. 7 shows a linear relationship between the quantity of inflated bladders and orientation angle $\alpha$ for a series of occupant characteristics (minimum, 25th percentile, 50th percentile, 75th percentile and maximum). Although the relationship is linear with respect to both $\alpha$ and occupant characteristics, nonlinear relationships are within the scope of this disclosure.

Figure 8:
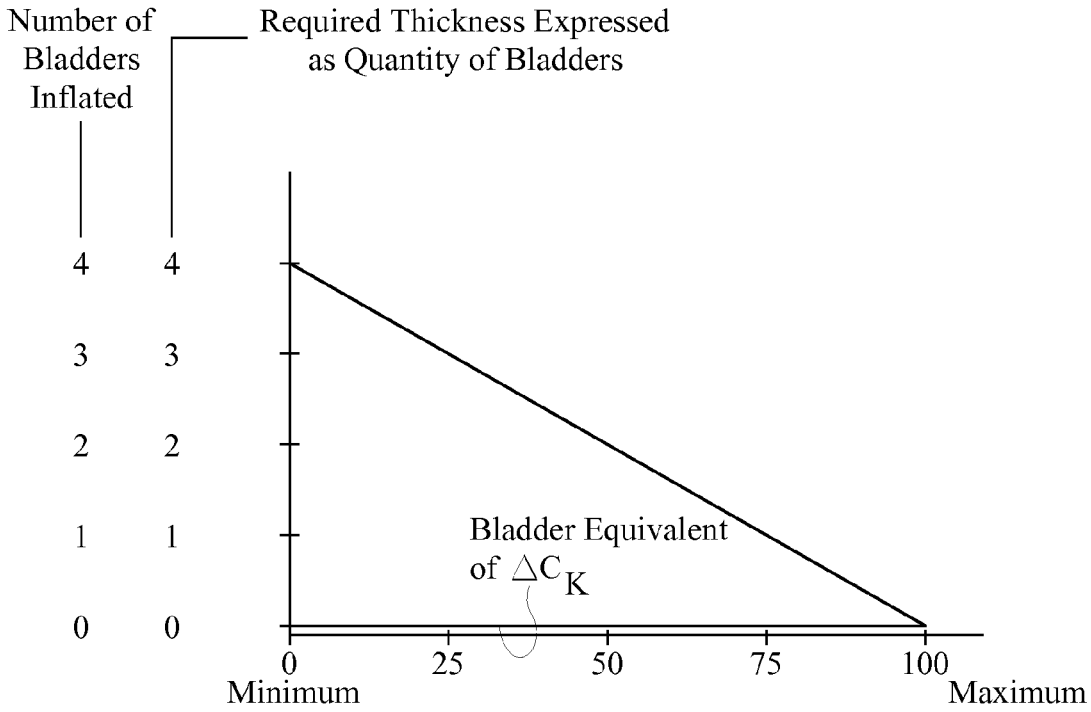
FIG. 8 is a graph illustrating bladder inflation requirements as a function of occupant size for a bed whose longitudinal deck translation $\Delta C_K$ is based on a maximum occupant.

FIG. 8 is a graph summarizing the examples of FIGS. 3-6 and also represents a control schedule useable by controller 72. The graph is for a bed whose upper body section translation at maximum $\alpha$ is $\Delta C_K$ based on a maximum occupant. The horizontal axis shows occupant characteristic(s) expressed as a percentile. The vertical axis shows two scales. One scale, labeled "REQUIRED THICKNESS", indicates the quantity of bladder thicknesses required by the occupant at maximum $\alpha$ assuming the bladders in question are fully inflated and are therefore at their maximum volume and at a known maximum thickness. The other scale, labeled "BLADDERS INFLATED", indicates the quantity of bladders to be inflated to achieve the required bladder thickness at maximum $\alpha$ (and therefore the required mattress thickness at maximum $\alpha$). Interpolation as described earlier can be used to accommodate orientation angles less than the maximum angle. The graph has a horizontal line showing the "bladder equivalent" of the deck upper body section translation $\Delta C_K$. The horizontal line is at zero because $\Delta C_K$, being based on a maximum occupant, provides none of the effect of the compensatory bladders. The sloped line read against the "REQUIRED THICKNESS" scale shows the quantity of bladders required by the occupant in question. The sloped line read against the "BLADDERS INFLATED" scale shows the quantity of bladders to be inflated to accommodate the occupant in question. The values on each scale are equal because the translation of the upper body section ($\Delta C_K$) is the equivalent of inflating zero bladders. Hence, all of the required thickness has to be provided by the compensatory bladders themselves.

Continuing to refer to FIG. 8, if an occupant requires inflation of a nonintegral quantity of bladders the controller commands full inflation of a quantity of bladders equal to the integral portion of the nonintegral quantity and commands partial inflation of an additional bladder. The additional bladder is inflated to a pressure approximately equal to a full inflation pressure multiplied by the fractional part of the nonintegral quantity. For example for a 70th percentile occupant the controller would call for full inflation of bladder 64A (FIG. 2) and for inflation of bladder 64B to a pressure of about 20% of the pressure corresponding to maximum inflation.

In general if the volumetrically adjustable element is a set of N inflatable bladders and if $\Delta C_K$ is based on a maximum occupant (as in FIG. 8), the controller commands inflation of the bladders as a function of occupant characteristics and deck section orientation as specified in an inflation schedule set forth below. As already noted a bladder may be partially inflated according to a linear or nonlinear interpolation algorithm for deck orientations between the maximum and minimum orientations and for occupant characteristics between maximum and minimum occupant characteristics.

| | Inflated bladder quantity at maximum orientation of the deck section | Inflated bladder quantity at minimum orientation of the deck section |
|---|---|---|
| Minimum Occupant (0th percentile) | N | 0 |
| Maximum Occupant (100th percentile) | M where M < N | 0 |

Figure 9:
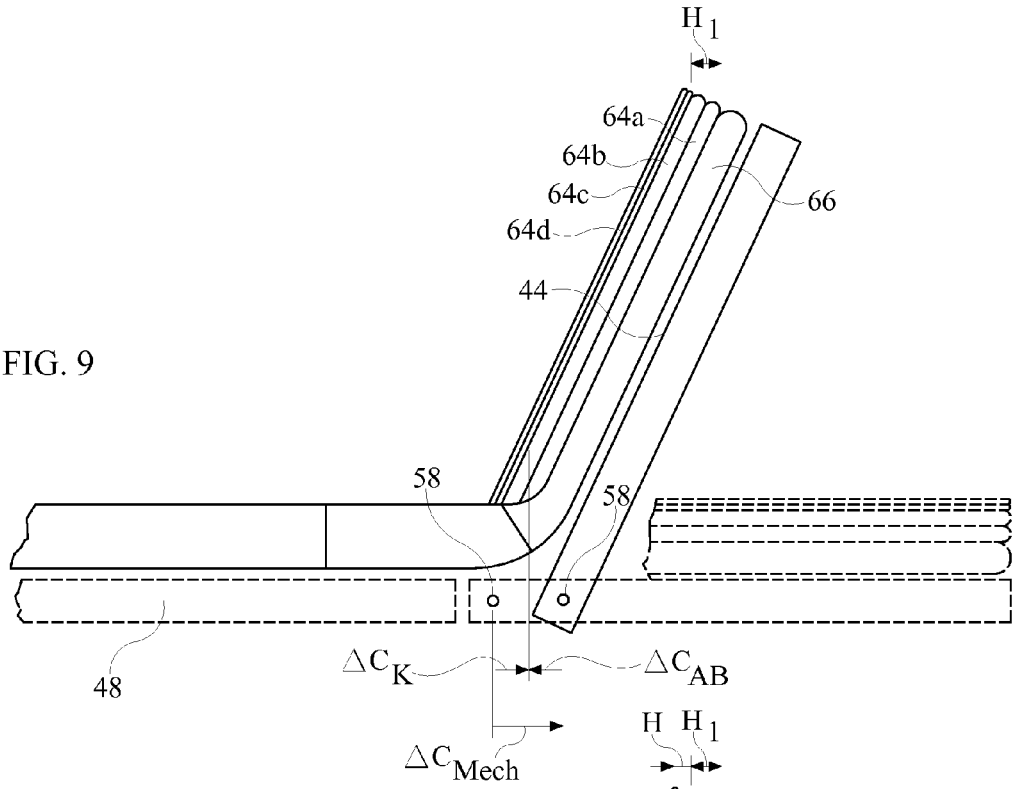
FIGS. 9-11 are side elevation views similar to those of FIGS. 3-6 except that the value of $\Delta C_K$ has been chosen to accommodate a 50th percentile occupant rather than a 100th percentile occupant.

FIG. 9 is a side elevation view similar to that of FIGS. 3-6 but showing a bed for which the designer has selected a 50th percentile occupant as a "design point" occupant. As a result the value of $\Delta C_K$ prescribed by the designer has been chosen to accommodate a 50th percentile occupant rather than a 100th percentile occupant. This leads to a number of differences relative to FIGS. 3-6. First, mattress base 66 is only half as thick as the mattress base of FIGS. 3-6. Second, when deck section 44 is in a flat orientation, two of the four bladders 64 are inflated irrespective of the characteristics of the occupant. Third, $\Delta C_K$ is the net result of a mechanical translation $\Delta C_{MECH}$ of axis 58 and an oppositely directed offset $\Delta C_{AB}$ where the AB subscript signifies that the offset is attributable to the inflated state of bladders 64A and 64B. H1 is the horizontal component of mattress thickness attributable to the inflated state of bladders 64A, 64B. In the example of FIG. 9 controller 72, in response to the change in deck section orientation from 0° to 65°, commands thickness to change by a baseline amount for an occupant equivalent to the design occupant. In the example of FIG. 9 the controller has previously received a user input specifying that the occupant is a 50th percentile occupant. The command issued by the controller is a null command and the baseline amount is zero so that the two bladders 64C, 64D, which were uninflated at $\alpha$=0, remain uninflated, and the two bladders 64A, 64B which were fully inflated at $\alpha$=0, remain fully inflated thereby accommodating the 50th percentile bed occupant.

Figure 10:
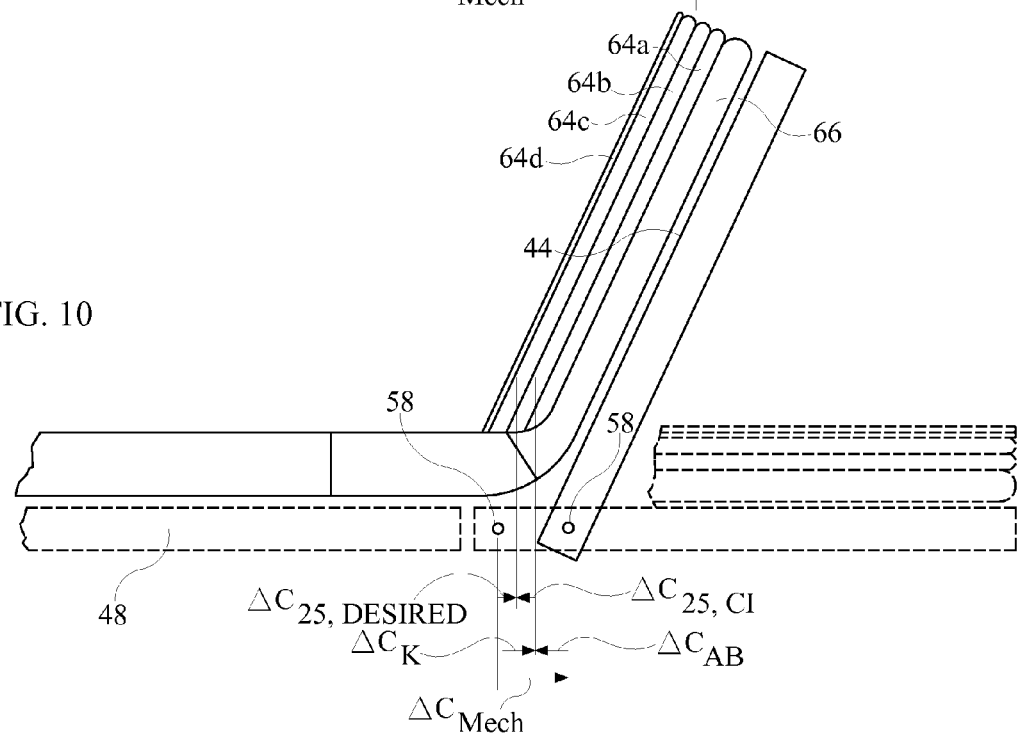

FIG. 10 shows operation of the bed of FIG. 9 for an occupant smaller than the design occupant. The specific example of FIG. 10 assumes that the occupant is a 25th percentile member of the population and that the controller 72 has been informed, by way of user input, that a 25th percentile individual is or will be occupying the bed. $\Delta C_K$, the net result of $\Delta C_{MECH}$ and offset $\Delta C_{AB}$, is consistent with the needs of a 50th percentile occupant. However this is nonoptimal for the 25th percentile occupant who requires only $\Delta C_{25,DESIRED}$. Hence, the controller has issued commands to change the thickness of the portion of the mattress assembly adjacent to deck section 44 by an amount compatible with the needs of the 25th percentile occupant. In the example of FIG. 10 the command is a command for full inflation of three of the four compensatory bladders 64, i.e. to maintain the inflation of bladders 64A and 64B and to inflate additional bladder 64C. The resulting increase in the horizontal component H of the thickness of the mattress assembly adjacent to upper body section deck section 44 is $\Delta C_{25,CI}$ where the "CI" portion of the subscript stands for "compensatory inflation". The magnitude of $\Delta C_{25,CI}$ compensates for the fact that $\Delta C_{MECH}$ offset by $\Delta C_{AB}$ (an offset compatible with the 50th percentile design point occupant) is insufficient offset for the 25th percentile occupant.

Figure 11:
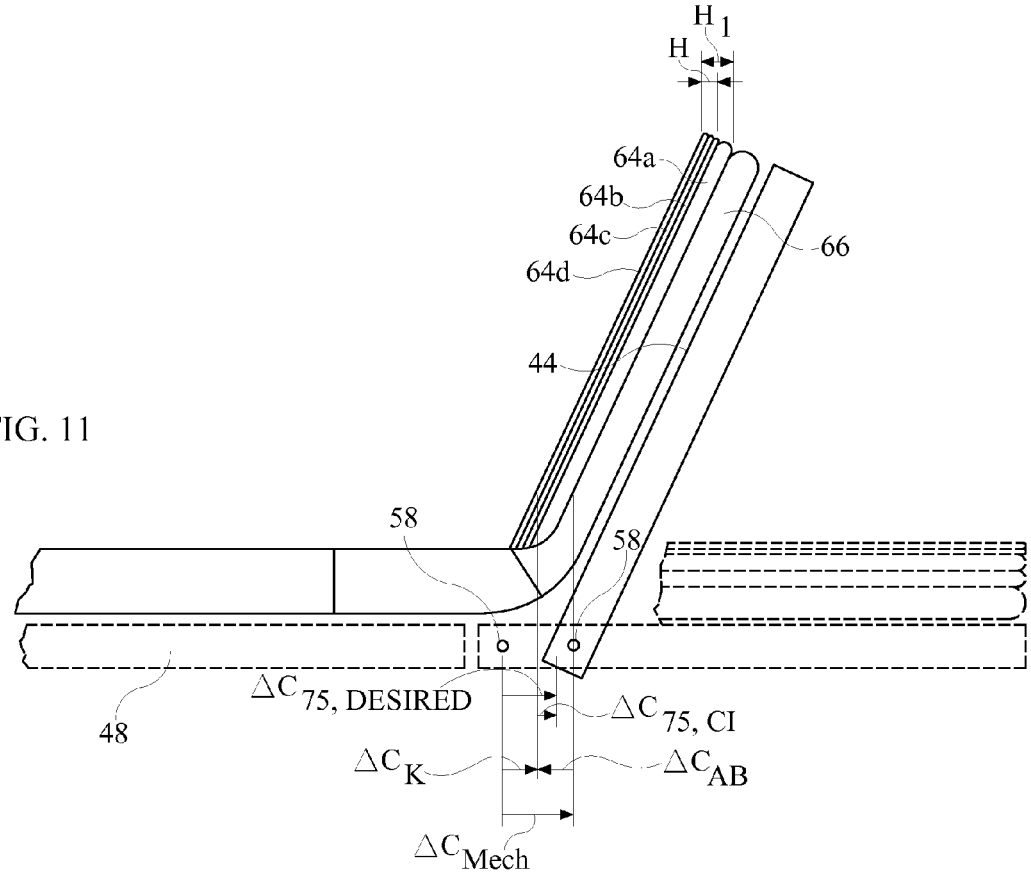

FIG. 11 shows operation of the bed of FIG. 9 for an occupant larger than the 50th percentile design occupant. The specific example of FIG. 11 assumes that the occupant is a 75th percentile member of the population and that the controller 72 has been informed, by way of user input, that a 75th percentile individual is or will be occupying the bed. ΔCK, the net result of ΔCMECH and offset ΔCAB, is consistent with the needs of a 50th percentile occupant. However this is nonoptimal for the 75th percentile occupant who requires ΔC75, DESIRED. Hence, the controller has issued commands to change the thickness of the portion of the mattress assembly adjacent to deck section 44 by an amount compatible with the needs of the 75th percentile occupant. In the example of FIG. 11 the command is a command for full inflation of only one of the four compensatory bladders 64, i.e. to maintain the inflation of bladder 64A and to deflate the other bladder (64B) that is normally inflated at all deck orientations for the 50th percentile occupant. The resulting reduction of the horizontal component H of thickness of the mattress assembly adjacent to upper body section deck section 44 is ΔC75,CI where the "CI" portion of the subscript stands for "compensatory inflation, which in this example happens to be a deflation. The magnitude of ΔC75,CI compensates for the fact that ΔCMECH offset by ΔCPNEUMATIC (an offset compatible with the 50th percentile design point occupant) is excessive offset for the 75th percentile occupant.

Figure 12:
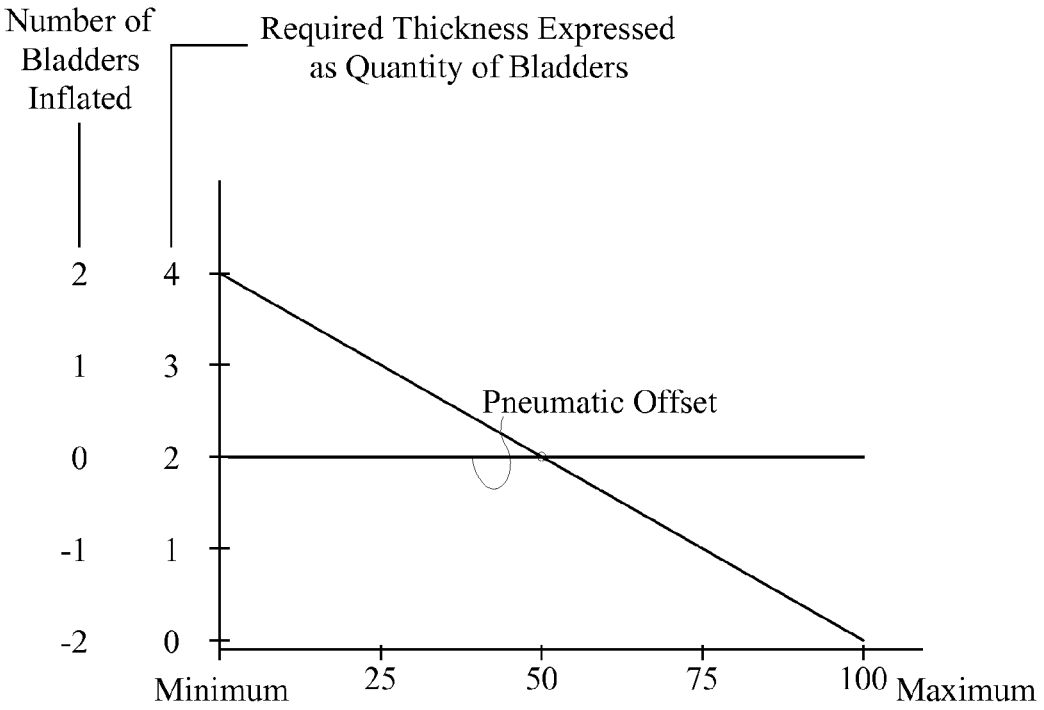
FIG. 12 is a view similar to that of FIG. 8 for a bed whose longitudinal deck translation is based on a 50th percentile occupant.

FIG. 12 is a graph summarizing the examples of FIGS. 9-11 and also represents a control schedule useable by controller 72. The graph is for a bed whose upper body section translation at maximum α is $\Delta C_K$ based on a 50th percentile design point occupant. The horizontal axis shows occupant characteristic(s) expressed as a percentile. The vertical axis shows two scales. One scale, labeled "REQUIRED THICKNESS", indicates the quantity of bladder thicknesses required by the occupant at maximum α assuming the bladders in question are fully inflated and are therefore at their maximum volume and at a known maximum thickness. The other scale, labeled "BLADDERS INFLATED", indicates the quantity of bladders to be inflated (relative to the number inflated for the 50th percentile design point occupant) to achieve the required bladder thickness at maximum α (and therefore the required mattress thickness at maximum α). Interpolation as described earlier can be used to accommodate orientation angles less than the maximum angle. The graph has a horizontal line showing the offset attributable to inflation of bladders 64A, 64B. The sloped line read against the "REQUIRED THICKNESS" scale shows the quantity of bladders required by the occupant in question. The sloped line read against the "BLADDERS INFLATED" scale shows the quantity of bladders to be inflated (positive values) or deflated (negative values) relative to the quantity of bladders inflated for a design point occupant to accommodate the occupant in question.

In general if the volumetrically adjustable element is a set of P inflatable bladders, if $\Delta C_K$ is based on a design occupant who is less than a maximum occupant and greater than a minimum occupant, and if the quantity of bladders required to be inflated for the 50th percentile design point occupant is P, the controller commands inflation of the bladders as a function of occupant characteristics and deck section orientation as specified in an inflation schedule set forth below.

| | Inflated bladder quantity at maximum orientation of the deck section | Inflated bladder quantity at minimum orientation of the deck section |
|---|---|---|
| Occupant greater than Design Occupant | R where R < P | P |
| Occupant equivalent to Design Occupant (Design Occupant <100th percentile) | P | P |
| Occupant Less than Design Occupant and >0th percentile) | Q where Q > P | P |

Figure 13:
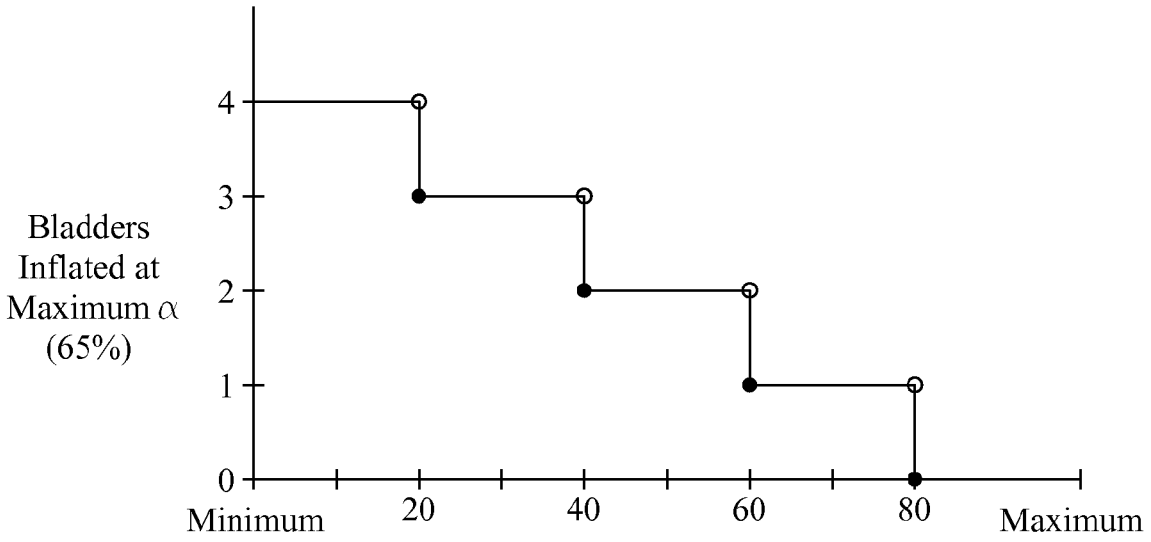
FIG. 13 is a discrete schedule of bladder inflation.

FIG. 13 is a graph showing a discrete or stepwise inflation scheme which is an alternative to the continuous inflation scheme of, for example, FIG. 8. The graph also represents a control schedule useable by controller 72. The schedule is for a bed whose upper body section translation at maximum α is $\Delta C_K$ based on a maximum occupant. The horizontal axis shows occupant characteristic(s) expressed as a percentile. Inflated bladder quantity can be linearly or nonlinearly interpolated for deck orientations between the maximum and minimum orientations, however the illustrated control schedule does not provide for partial inflation of bladders (i.e interpolation along the occupant characteristic(s) axis. Instead, each bladder is either fully inflated or substantially deflated as set forth below:

| Occupant characteristics | Inflated bladder count at maximum deck section orientation | Inflated bladder count at minimum deck section orientation |
|---|---|---|
| Minimum Occupant ≤ occupant < 20th percentile | 4 | 0 |
| 20th percentile ≤ occupant < 40th percentile | 3 | 0 |
| 40th percentile ≤ occupant < 60th percentile | 2 | 0 |
| 60th percentile ≤ occupant < 80th percentile | 1 | 0 |

-continued

| Occupant characteristics | Inflated bladder count at maximum deck section orientation | Inflated bladder count at minimum deck section orientation |
|---|---|---|
| 80th percentile ≤ occupant < Maximum Occupant | 0 | 0 |

More generally, if n bladders are used, bladder inflation can be easily allocated among n+1 ranges of occupant size according to the schedule below, which assumes that the ranges are equally sized and in which lower percentile range numbers correspond to larger occupants.

| Occupant characteristics (i.e. percentile range) | Inflated bladder count at maximum deck section orientation | Inflated bladder count at minimum deck section orientation |
|---|---|---|
| n + 1 | n | 0 |
| . | . | . |
| . | . | . |
| . | . | . |
| 4 | 3 | 0 |
| 3 | 2 | 0 |
| 2 | 1 | 0 |
| 1 | 0 | 0 |

Although this disclosure refers to specific embodiments, it will be understood by those skilled in the art that various changes in form and detail may be made without departing from the subject matter set forth in the accompanying claims.

We claim:

1. A bed comprising:

a deck having at least one section that is orientation adjustable about a laterally extending, longitudinally translatable axis that translates a prescribed distance in response to a change in orientation of the deck section;

a mattress assembly including at least one volumetrically adjustable element associated with the orientation adjustable deck section, the element comprised of a set of N inflated and deflatable bladders adapted to change the thickness of a portion of the mattress assembly adjacent to the deck section in a direction nonparallel to the orientation of the section; and a controller adapted to command bladder inflation as a function of occupant characteristics and the orientation of the orientation adjustable deck section as specified in an inflation schedule set forth below.

| | Inflated bladder quantity at maximum orientation of the deck section | Inflated bladder quantity at minimum orientation of the deck section |
|---|---|---|
| Minimum Occupant (0th percentile) | N | 0 |

-continued

| | Inflated bladder quantity at maximum orientation of the deck section | Inflated bladder quantity at minimum orientation of the deck section |
|---|---|---|
| Maximum Occupant (100th percentile). | M where M < N | 0 |

2. The bed of claim 1 including a blower for pressurizing the volumetrically adjustable element.

3. The bed of claim 1 comprising multiple inflatable bladders each capable of effecting only part of a maximum attainable change in the thickness of the mattress assembly.

4. The bed of claim 1 in which the mattress assembly includes a substantially constant thickness base between the volumetrically adjustable element and the orientation adjustable deck section.

5. The bed of claim 1 in which the axis translates headwardly in concert with a positive change in deck section orientation, and the adjustable element changes the thickness of the portion of the mattress assembly by a baseline amount for a maximum bed occupant and by a greater amount for a less than maximum occupant.

6. The bed of claim 5 in which the baseline amount is zero at a maximum positive orientation of the deck section.

7. The bed of claim 1 in which the axis translates headwardly a prescribed distance in concert with a positive change in deck section orientation, and the adjustable element changes the thickness of the portion of the mattress assembly by a baseline amount for a design point occupant who is less than a maximum occupant and more than a minimum occupant and by a greater amount for an occupant smaller than the design point occupant.

8. The bed of claim 7 in which the adjustable element changes the thickness of the portion of the mattress assembly by less than the baseline amount for an occupant who is larger than the design point occupant.

9. The bed of claim 7 in which the design point occupant is a 50th percentile member of a population.

10. The bed of claim 1 wherein the inflated bladder quantity is interpolated for deck orientations between maximum and minimum orientations and for occupant characteristics between maximum and minimum occupant characteristics.

11. The bed of claim 10 wherein in the event that the inflation schedule calls for a nonintegral quantity of bladders to be inflated, the controller commands full inflation of a quantity of bladders equal to the integral portion of the nonintegral quantity and commands partial inflation of an additional bladder.

12. The bed of claim 11 in which the additional bladder is inflated to a pressure approximately equal to a full inflation pressure multiplied by the fractional part of the nonintegral quantity.

13. The bed of claim 1 in which the volumetrically adjustable element is a set of P inflatable bladders and the controller is adapted to command bladder inflation as a function of occupant characteristics and deck section orientation as specified in an inflation schedule set forth below

| | Inflated bladder quantity at maximum orientation of the deck section | Inflated bladder quantity at minimum orientation of the deck section |
|---|---|---|
| Occupant greater than Design Occupant | R where R < P | P |
| Occupant equivalent to Design Occupant (Design Occupant <100th percentile) | P | P |
| Occupant Less than Design Occupant and >0th percentile). | Q where Q > P | P |

14. The bed of claim 13 wherein in the event that the inflation schedule calls for a nonintegral quantity of bladders to be inflated, the controller commands full inflation of a quantity of bladders equal to the integral portion of the nonintegral quantity and commands partial inflation of an additional bladder.

15. The bed of claim 14 in which the additional bladder is inflated to a pressure approximately equal to a full inflation pressure multiplied by the fractional part of the nonintegral quantity.

16. The bed of claim 13 wherein the inflated bladder quantity is interpolated for deck orientations between maximum and minimum orientations and for occupant characteristics between the characteristics of a design point occupant and the characteristics of occupants smaller or larger than the design point occupant.

17. The bed of claim 1 in which the controller commands bladder inflation as specified in an inflation schedule set forth below

| Occupant characteristics | Inflated bladder count at maximum deck section orientation | Inflated bladder count at minimum deck section orientation |
|---|---|---|
| Minimum Occupant ≤ occupant < 20th percentile | N | 0 |
| 20th percentile ≤ occupant < 40th percentile | N − 1 | 0 |
| 40th percentile ≤ occupant < 60th percentile | N − 2 | 0 |
| 60th percentile ≤ occupant < 80th percentile | N − 3 | 0 |
| 80th percentile ≤ occupant < Maximum Occupant. | N − 4 | 0 |

18. The bed of claim 17 wherein in the event that the inflation schedule calls for a nonintegral quantity of bladders to be inflated, the controller commands full inflation of a quantity of bladders equal to the integral portion of the nonintegral quantity and commands partial inflation of an additional bladder.

19. The bed of claim 18 in which the additional bladder is inflated to a pressure approximately equal to a full inflation pressure multiplied by the fractional part of the nonintegral quantity.

20. The bed of claim 17 wherein the inflated bladder quantity is interpolated for deck orientations between the maximum and minimum orientations.

21. The bed of claim 1 in which the controller commands bladder inflation as specified in an inflation schedule set forth below where lower percentile range numbers correspond to larger occupants

| Occupant characteristics (i.e. percentile range) | Inflated bladder count at maximum deck section orientation | Inflated bladder count at minimum deck section orientation |
|---|---|---|
| n + 1 | n | 0 |
| . | . | . |
| . | . | . |
| . | . | . |
| 4 | 3 | 0 |
| 3 | 2 | 0 |
| 2 | 1 | 0 |
| 1 | 0 | 0. |

22. The bed of claim 21 wherein the inflated bladder quantity is interpolated for deck orientations between the maximum and minimum orientations.

23. The bed of claim 1 wherein the deck section is also slidable in a direction parallel to the existing orientation of the deck section.

24. A bed comprising:

a deck having at least one section that is orientation adjustable about a laterally extending, longitudinally translatable axis that translates a prescribed distance in response to a change in orientation of the deck section;

a mattress assembly including a volumetrically adjustable element comprised of multiple inflatable bladders associated with the orientation adjustable deck section and distributed in a direction substantially perpendicular to the orientation of the deck section, the bladders adapted to change the thickness of a portion of the mattress assembly adjacent to the deck section in a direction nonparallel to the orientation of the section; and a controller for commanding inflation of a selected quantity of the bladders in response to the change in orientation of the deck section thereby regulating the change of thickness.

25. The bed of claim 24 wherein each bladder is capable of effecting only part of a maximum attainable change in the thickness of the mattress assembly.

26. The bed of claim 24 in which the axis translates headwardly in concert with a positive change in deck section orientation, and the adjustable element changes the thickness of the portion of the mattress assembly by a baseline amount for a maximum bed occupant and by a greater amount for a less than maximum occupant.

27. The bed of claim 26 in which the baseline amount is zero at a maximum positive orientation of the deck section.

28. The bed of claim 24 in which the axis translates headwardly a prescribed distance in concert with a positive change in deck section orientation, and the adjustable element changes the thickness of the portion of the mattress assembly by a baseline amount for a design point occupant who is less than a maximum occupant and more than a minimum occupant and by a greater amount for an occupant smaller than the design point occupant.

29. The bed of claim 28 in which the adjustable element changes the thickness of the portion of the mattress assembly by less than the baseline amount for an occupant who is larger than the design point occupant.

30. The bed of claim 28 in which the design point occupant is a 50th percentile member of a population.

31. The bed of claim 24 in which the volumetrically adjustable element is a set of N inflatable bladders and in which the controller is adapted to command inflation of the bladders as a function of occupant characteristics and deck section orientation as specified in an inflation schedule set forth below.

| | Inflated bladder quantity at maximum orientation of the deck section | Inflated bladder quantity at minimum orientation of the deck section |
|---|---|---|
| Minimum Occupant (0th percentile) | N | 0 |
| Maximum Occupant (100th percentile). | M where M < N | 0 |

32. The bed of claim 31 wherein the inflated bladder quantity is interpolated for deck orientations between maximum and minimum orientations.

33. The bed of claim 31 wherein in the event that the inflation schedule calls for a nonintegral quantity of bladders to be inflated, the controller commands full inflation of a quantity of bladders equal to the integral portion of the nonintegral quantity and commands partial inflation of an additional bladder.

34. The bed of claim 33 in which the additional bladder is inflated to a pressure approximately equal to a full inflation pressure multiplied by the fractional part of the nonintegral quantity.

35. The bed of claim 24 in which the volumetrically adjustable element is a set of P inflatable bladders and in which the controller is adapted to command inflation of the bladders as a function of occupant characteristics and deck section orientation as specified in an inflation schedule set forth below

| | Inflated bladder quantity at maximum orientation of the deck section | Inflated bladder quantity at minimum orientation of the deck section |
|---|---|---|
| Occupant greater than Design Occupant | R where R < P | P |
| Occupant equivalent to Design Occupant (Design Occupant <100th percentile) | P | P |
| Occupant Less than Design Occupant and >0th percentile). | Q where Q > P | P |

36. The bed of claim 35 wherein the inflated bladder quantity is interpolated for deck orientations between maximum and minimum orientations and for occupant characteristics between the characteristics of a design point occupant and the characteristics of occupants smaller or larger than the design point occupant.

37. The bed of claim 35 wherein in the event that the inflation schedule calls for a nonintegral quantity of bladders to be inflated, the controller commands full inflation of a quantity of bladders equal to the integral portion of the nonintegral quantity and commands partial inflation of an additional bladder.

38. The bed of claim 37 in which the additional bladder is inflated to a pressure approximately equal to a full inflation pressure multiplied by the fractional part of the nonintegral quantity.

39. The bed of claim 24 in which the volumetrically adjustable element is a set of N inflatable bladders and in which the controller is adapted to command inflation of the bladders as a function of occupant characteristics and deck section orientation as specified in an inflation schedule set forth below

| Occupant characteristics | Inflated bladder count at maximum deck section orientation | Inflated bladder count at minimum deck section orientation |
|---|---|---|
| Minimum Occupant ≤ occupant < 20th percentile | N | 0 |
| 20th percentile ≤ occupant < 40th percentile | N − 1 | 0 |
| 40th percentile ≤ occupant < 60th percentile | N − 2 | 0 |
| 60th percentile ≤ occupant < 80th percentile | N − 3 | 0 |
| 80th percentile ≤ occupant < Maximum Occupant. | N − 4 | 0 |

40. The bed of claim 39 wherein the inflated bladder quantity is interpolated for deck orientations between the maximum and minimum orientations.

41. The bed of claim 39 wherein in the event that the inflation schedule calls for a nonintegral quantity of bladders to be inflated, the controller commands full inflation of a quantity of bladders equal to the integral portion of the nonintegral quantity and commands partial inflation of an additional bladder.

42. The bed of claim 41 in which the additional bladder is inflated to a pressure approximately equal to a full inflation pressure multiplied by the fractional part of the nonintegral quantity.

43. The bed of claim 24 in which the volumetrically adjustable element is a set of n inflatable bladders and in which the controller is adapted to command inflation of the bladders as a function of occupant characteristics and deck section orientation as specified in an inflation schedule set forth below where lower percentile range numbers correspond to larger occupants

| Occupant characteristics (i.e. percentile range) | Inflated bladder count at maximum deck section orientation | Inflated bladder count at minimum deck section orientation |
|---|---|---|
| n + 1 | n | 0 |
| . | . | . |
| . | . | . |
| . | . | . |
| 4 | 3 | 0 |
| 3 | 2 | 0 |
| 2 | 1 | 0 |
| 1 | 0 | 0. |

44. The bed of claim 43 wherein the inflated bladder quantity is interpolated for deck orientations between the maximum and minimum orientations.

45. The bed of claim 24 wherein the deck section is also slidable in a direction parallel to the existing orientation of the deck section.

46. A bed comprising:

a deck having an upper body section which is orientation adjustable about a laterally extending, longitudinally translatable axis that translates a prescribed distance in response to a change in orientation of the upper body deck section; and a mattress assembly including at least one volumetrically adjustable element comprised of multiple inflatable bladders associated with the upper body deck section, the element adapted to change the thickness of a portion of the mattress assembly adjacent to the deck section in a direction nonparallel to the orientation of the section and;

a controller for regulating the change of thickness by commanding inflation of a selected quantity of the bladders in response to the change in orientation of the deck upper body section.

47. The bed of claim 46 wherein each bladder is capable of effecting only part of a maximum attainable change in the thickness of the mattress assembly.

48. The bed of claim 46 in which the axis translates headwardly in concert with a positive change in upper body deck section orientation, and the adjustable element changes the thickness of the portion of the mattress assembly by a baseline amount for a maximum bed occupant and by a greater amount for a less than maximum occupant.

49. The bed of claim 48 in which the baseline amount is zero at a maximum positive orientation of the deck upper body section.

50. The bed of claim 46 in which the axis translates headwardly a prescribed distance in concert with a positive change in upper body deck section orientation, and the adjustable element changes the thickness of the portion of the mattress assembly by a baseline amount for a design point occupant who is less than a maximum occupant and more than a minimum occupant and by a greater amount for an occupant smaller than the design point occupant.

51. The bed of claim 50 in which the adjustable element changes the thickness of the portion of the mattress assembly by less than the baseline amount for an occupant who is larger than the design point occupant.

52. The bed of claim 46 in which the volumetrically adjustable element is a set of N inflatable bladders and in which the controller is adapted to command inflation of the bladders as a function of occupant characteristics and deck section orientation as specified in an inflation schedule set forth below

| | Inflated bladder quantity at maximum orientation of the deck section | Inflated bladder quantity at minimum orientation of the deck section |
|---|---|---|
| Minimum Occupant (0th percentile) | N | 0 |
| Maximum Occupant (100th percentile). | M where M < N | 0 |

53. The bed of claim 52 wherein the inflated bladder quantity is interpolated for deck orientations between maximum and minimum orientations and for occupant characteristics between maximum and minimum occupant characteristics.

54. The bed of claim 52 wherein in the event that the inflation schedule calls for a nonintegral quantity of bladders to be inflated, the controller commands full inflation of a quantity of bladders equal to the integral portion of the nonintegral quantity and commands partial inflation of an additional bladder.

55. The bed of claim 54 in which the additional bladder is inflated to a pressure approximately equal to a full inflation pressure multiplied by the fractional part of the nonintegral quantity.

56. The bed of claim 46 in which the volumetrically adjustable element is a set of P inflatable bladders and in which the controller is adapted to command inflation of the bladders as a function of occupant characteristics and deck section orientation as specified in an inflation schedule set forth below

| | Inflated bladder quantity at maximum orientation of the deck section | Inflated bladder quantity at minimum orientation of the deck section |
|---|---|---|
| Occupant greater than Design Occupant | R where R < P | P |
| Occupant equivalent to Design Occupant (Design Occupant <100th percentile) | P | P |
| Occupant Less than Design Occupant and >0th percentile). | Q where Q > P | P |

57. The bed of claim 56 wherein the inflated bladder quantity is interpolated for upper body deck section orientations between maximum and minimum orientations and for occupant characteristics between the characteristics of a design point occupant and the characteristics of occupants smaller or larger than the design point occupant.

58. The bed of claim 56 wherein in the event that the inflation schedule calls for a nonintegral quantity of bladders to be inflated, the controller commands full inflation of a quantity of bladders equal to the integral portion of the nonintegral quantity and commands partial inflation of an additional bladder.

59. The bed of claim 58 in which the additional bladder is inflated to a pressure approximately equal to a full inflation pressure multiplied by the fractional part of the nonintegral quantity.

60. The bed of claim 46 in which the volumetrically adjustable element is a set of N inflatable bladders and in which the controller is adapted to command inflation of the bladders as a function of occupant characteristics and deck section orientation as specified in an inflation schedule set forth below

| Occupant characteristics | Inflated bladder count at maximum deck section orientation | Inflated bladder count at minimum deck section orientation |
|---|---|---|
| Minimum Occupant ≤ occupant < 20th percentile | N | 0 |
| 20th percentile ≤ occupant < 40th percentile | N − 1 | 0 |
| 40th percentile ≤ occupant < 60th percentile | N − 2 | 0 |
| 60th percentile ≤ occupant < 80th percentile | N − 3 | 0 |
| 80th percentile ≤ occupant < Maximum Occupant. | N − 4 | 0 |

61. The bed of claim 60 and with inflated bladder quantity being interpolated for deck orientations between the maximum and minimum orientations.

62. The bed of claim 60 wherein in the event that the inflation schedule calls for a nonintegral quantity of bladders to be inflated, the controller commands full inflation of a quantity of bladders equal to the integral portion of the nonintegral quantity and commands partial inflation of an additional bladder.

63. The bed of claim 62 in which the additional bladder is inflated to a pressure approximately equal to a full inflation pressure multiplied by the fractional part of the nonintegral quantity.

64. The bed of claim 46 in which the volumetrically adjustable element is a set of n inflatable bladders and in which the controller is adapted to command inflation of the bladders as a function of occupant characteristics and deck section orientation as specified in an inflation schedule set forth below where lower percentile range numbers correspond to larger occupants

| Occupant characteristics (i.e. percentile range) | Inflated bladder count at maximum deck section orientation | Inflated bladder count at minimum deck section orientation |
|---|---|---|
| n + 1 | n | 0 |
| . | . | . |
| . | . | . |
| . | . | . |
| 4 | 3 | 0 |
| 3 | 2 | 0 |
| 2 | 1 | 0 |
| 1 | 0 | 0. |

65. the bed of claim 64 wherein the inflated bladder quantity is interpolated for deck orientations between the maximum and minimum orientations.

66. The bed of claim 46 wherein the deck section is also slidable in a direction parallel to the existing orientation of the deck section.

67. A bed comprising:

a deck having at least one section that is orientation adjustable about a laterally extending, longitudinally translatable axis that translates a prescribed distance in response to a change in orientation of the deck section; and a mattress assembly including at least one volumetrically adjustable element associated with the orientation adjustable deck section, the volumetrically adjustable element comprised of at least two inflatable bladders and adapted to change the thickness of a portion of the mattress assembly adjacent to the deck section in a direction nonparallel to the orientation of the section; and a controller for regulating the change of thickness by commanding inflation of a selected quantity of the bladders in response to the change in orientation of the deck section and the characteristics of the occupant.

68. The bed of claim 67 wherein each bladder is capable of effecting only part of a maximum attainable change in the thickness of the mattress assembly.

69. The bed of claim 67 in which the axis translates headwardly in concert with a positive change in deck section orientation, and the adjustable element changes the thickness of the portion of the mattress assembly by a baseline amount for a maximum bed occupant and by a greater amount for a less than maximum occupant.

70. The bed of claim 69 in which the baseline amount is zero at a maximum positive orientation of the deck section.

71. The bed of claim 67 in which the axis translates headwardly a prescribed distance in concert with a positive change in deck section orientation, and the adjustable element changes the thickness of the portion of the mattress assembly by a baseline amount for a design point occupant who is less than a maximum occupant and more than a minimum occupant and by a greater amount for an occupant smaller than the design point occupant.

72. The bed of claim 71 in which the adjustable element changes the thickness of the portion of the mattress assembly by less than the baseline amount for an occupant who is larger than the design point occupant.

73. The bed of claim 67 in which the volumetrically adjustable element is a set of P inflatable bladders and in which the controller commands inflation of the bladders as a function of occupant characteristics and deck section orientation as specified in an inflation schedule set forth below

| | Inflated bladder quantity at maximum orientation of the deck section | Inflated bladder quantity at minimum orientation of the deck section |
|---|---|---|
| Occupant greater than Design Occupant | R where R < P | P |
| Occupant equivalent to Design Occupant (Design Occupant <100th percentile) | P | P |
| Occupant Less than Design Occupant and >0th percentile). | Q where Q > P | P |

74. The bed of claim 73 wherein the inflated bladder quantity is interpolated for deck orientations between maximum and minimum orientations and for occupant characteristics between the characteristics of a design point occupant and the characteristics of occupants smaller or larger than the design point occupant.

75. The bed of claim 73 wherein in the event that the inflation schedule calls for a nonintegral quantity of bladders to be inflated, the controller commands full inflation of a quantity of bladders equal to the integral portion of the nonintegral quantity and commands partial inflation of an additional bladder.

76. The bed of claim 75 in which the additional bladder is inflated to a pressure approximately equal to a full inflation pressure multiplied by the fractional part of the nonintegral quantity.

77. The bed of claim 67 in which the volumetrically adjustable element is a set of N inflatable bladders and in which the controller is adapted to command inflation of the bladders as a function of occupant characteristics and deck section orientation as specified in an inflation schedule set forth below

| Occupant characteristics | Inflated bladder count at maximum deck section orientation | Inflated bladder count at minimum deck section orientation |
|---|---|---|
| Minimum Occupant ≤ occupant < 20th percentile | N | 0 |
| 20th percentile ≤ occupant < 40th percentile | N − 1 | 0 |
| 40th percentile ≤ occupant < | N − 2 | 0 |

-continued

| Occupant characteristics | Inflated bladder count at maximum deck section orientation | Inflated bladder count at minimum deck section orientation |
|---|---|---|
| 60th percentile 60th percentile ≤ occupant < 80th percentile | N − 3 | 0 |
| 80th percentile ≤ occupant < Maximum Occupant. | N − 4 | 0 |

78. The bed of claim 77 wherein the inflated bladder quantity is interpolated for deck orientations between the maximum and minimum orientations.

79. The bed of claim 77 wherein in the event that the inflation schedule calls for a nonintegral quantity of bladders to be inflated, the controller commands full inflation of a quantity of bladders equal to the integral portion of the nonintegral quantity and commands partial inflation of an additional bladder.

80. The bed of claim 79 in which the additional bladder is inflated to a pressure approximately equal to a full inflation pressure multiplied by the fractional part of the nonintegral quantity.

81. The bed of claim 67 in which the volumetrically adjustable element is a set of n inflatable bladders and in which the controller is adapted to command inflation of the bladders as a function of occupant characteristics and deck section orientation as specified in an inflation schedule set forth below where lower percentile range numbers correspond to larger occupants

| Occupant characteristics (i.e. percentile range) | Inflated bladder count at maximum deck section orientation | Inflated bladder count at minimum deck section orientation |
|---|---|---|
| n + 1 | n | 0 |
| . | . | . |
| . | . | . |
| . | . | . |
| 4 | 3 | 0 |
| 3 | 2 | 0 |
| 2 | 1 | 0 |
| 1 | 0 | 0. |

82. the bed of claim 81 wherein the inflated bladder quantity is interpolated for deck orientations between the maximum and minimum orientations.

83. The bed of claim 67 wherein the deck section is also slidable in a direction parallel to the existing orientation of the deck section.

* * * * *